United States Patent [19]

Jacob

[11] 4,089,081

[45] May 16, 1978

[54] APPARATUS FOR PURIFYING PARTICULATE MOULD MATERIAL

[76] Inventor: Hermann Jacob, Fachenfelderweg 115, 2105 Seevetal 3, Germany

[21] Appl. No.: 545,014

[22] Filed: Jan. 29, 1975

[30] Foreign Application Priority Data

| | | |
|---|---|---|
| Feb. 1, 1974 | Germany | 2404702 |
| Dec. 20, 1974 | Germany | 2460594 |

[51] Int. Cl.[2] ..... C10B 43/04

[52] U.S. Cl. ..... 15/93 R; 164/5; 34/20

[58] Field of Search ..... 259/145, 146, 157, 3, 259/14, 30, 15, 31, 57, 58, 82; 209/134, 135, 196; 164/412, 5; 34/20, 15, 31, 37, 58, 32, 7, 13, 62, 64, 164; 134/6, 7; 165/68; 201/10, 12; 15/95

[56] References Cited

U.S. PATENT DOCUMENTS

| | | | |
|---|---|---|---|
| 84,842 | 12/1868 | Reynolds | 34/20 X |
| 89,485 | 4/1869 | Johnson | 34/20 X |
| 271,604 | 2/1883 | Cook | 34/20 X |
| 624,515 | 5/1899 | Mallinson | 34/20 X |
| 1,034,861 | 8/1912 | Bear | 34/20 X |
| 1,145,772 | 7/1915 | Josey et al. | 34/20 X |
| 1,787,878 | 1/1931 | Warden-Stevens | 34/20 X |
| 2,138,240 | 11/1938 | Kobusch | 34/7 |
| 2,233,728 | 3/1941 | Bell | 164/5 |
| 2,420,376 | 5/1947 | Johansson | 34/164 |
| 2,602,242 | 7/1952 | Dok | 34/20 X |
| 2,635,949 | 4/1953 | Fenske | 34/164 |
| 2,683,938 | 7/1954 | Gustavsson | 34/20 X |
| 2,963,758 | 12/1960 | Pestel | 164/5 |
| 3,015,188 | 1/1962 | Reinecker | 259/82 |
| 3,161,485 | 12/1964 | Bührer | 164/5 |
| 3,231,512 | 1/1966 | Harter | 34/34 |

FOREIGN PATENT DOCUMENTS

| | | | |
|---|---|---|---|
| 1,195,226 | 6/1970 | United Kingdom | 164/412 |

OTHER PUBLICATIONS

*Shell Mold Job Shop* by Robert H. Herrman, "Foundry" Magazine, pp. 78–83, Feb. 1956.

*Primary Examiner*—Harvey C. Hornsby
*Assistant Examiner*—Robert Pous
*Attorney, Agent, or Firm*—Michael J. Striker

[57] ABSTRACT

Apparatus for purifying foundry sand which involves the passage of sand through layers of steel wool supported on perforated discs mounted on a vertical shaft in a standpipe. Perforations in the sides of the standpipe permit air to be blown through the sand as it drops down through the steel wool. The vertical shaft supporting the discs and steel wool is vibrated to cause the sand to move through and past the packs of steel wool.

4 Claims, 2 Drawing Figures

Fig.1
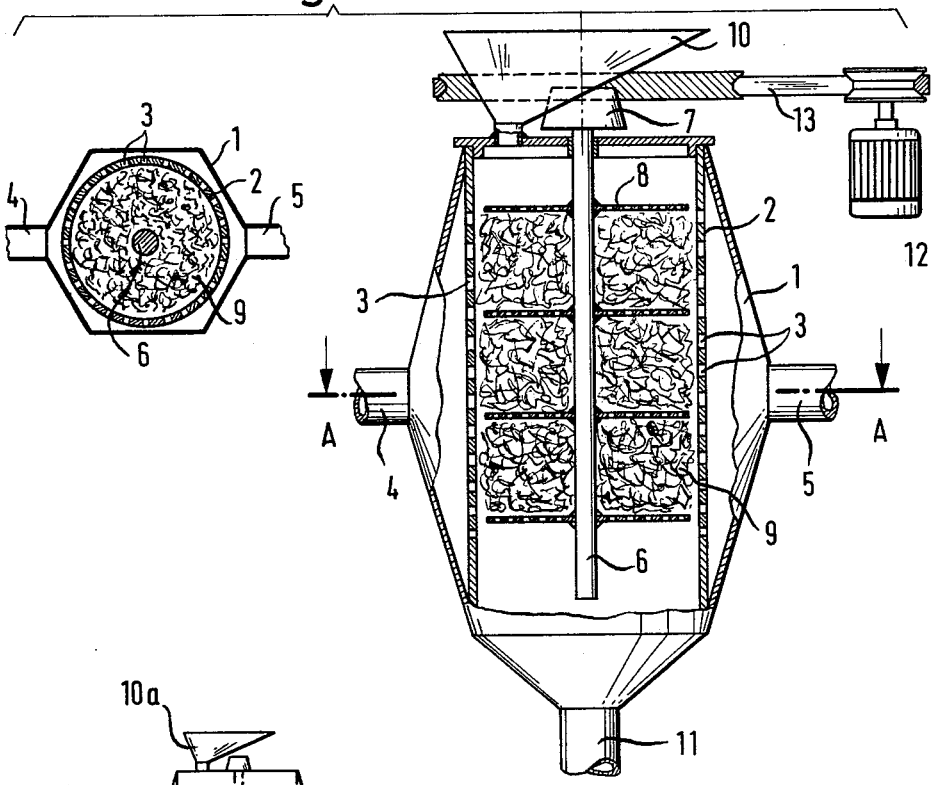
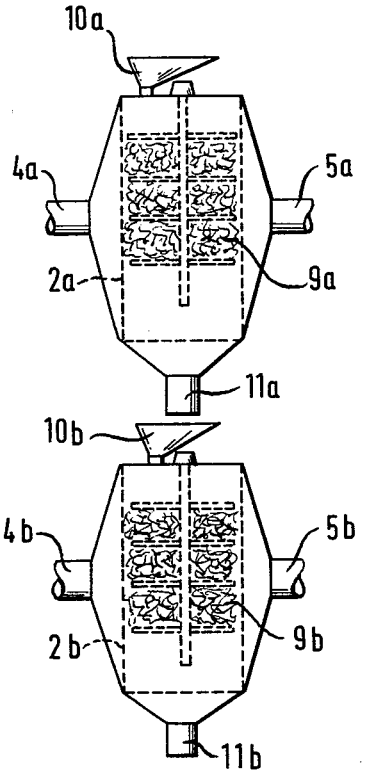
Fig.2

APPARATUS FOR PURIFYING PARTICULATE MOULD MATERIAL

The invention relates to a process for purifying foundry sand and to apparatus for carrying out the process.

The increasing employment of newly developed moulding processes and ancillary mould materials has necessitated the development of suitable pre-treatment machines. These include installations for regenerating used foundry sands, optionally with simultaneous heat exchange. Repeated use of mould materials is desirable not only on economic but also environmental grounds. Various processes are known, especially for regeneration of mould materials such as sand, which processes as a rule include simultaneous cooling of the sand, the foundry sand fed into the machine having a higher temperature than the air optionally used in carrying out the process. However, the cooling during this process is, as a rule, of subordinate significance to the main purpose of the process which is regeneration.

One such process is described, for example, in "GiessereiPraxis," 1961, page 156. In this process, regeneration of foundry sand is effected by impact of the sand on a rebound surface, a current of air being used to throw the sand against the surface. Transfer of heat may take place as a result of the contact between air and sand, such that the more or less hot sand is cooled by the air.

The cooling of used foundry sand by passing cool air through it is described in DT-OS 2,138,531, but the mere passing of cool air through the sand does not result in regeneration of the sand, and at best only removes loose particles of dust.

Regeneration plants usually have a final stage separation of dust, particularly using stepped- or cascade-purifiers, whereby the sand falls freely from step to step through a current of air and thus undergoes a final purification with simultaneous cooling.

We have now devised an improved process for purifying mould materials such as foundry sand, in which the purification is of improved efficiency and may be achieved simultaneously with transfer of heat, and which process can be carried out in a particularly advantageous manner using very simple apparatus.

According to the present invention, there is provided a process for purifying a particulate mould material such as foundry sand, which comprises contacting the material with metal by feeding the material past contact surfaces and edges of metal or bringing the material into contact with moving metal particles.

In the process of this invention, very effective, dry contact cooling with simultaneous purification of the foundry sand occurs, where metals of high heat-conductivity and extremely large surface areas (in relation to their volume) are used as contact surfaces. These materials are capable of absorbing heat quickly and well, and also of releasing it again. A large contact surface and, therefore, a large surface area, is very desirable for effective and speedy transfer of heat. This requirement is fulfilled excellently by using shredded 106 or splintered or chopped or the like or similar metallic all which we refer to as "finely divided metallic materials."

Preferably, steel wool or metal wool is used as the purifying- and contact-medium. A collection of finely chopped wire can also be utilised for the same purpose. Metal wool and steel wool do possess an extremely favourable surface/volume ratio and are therefore capable of participating with their large surfaces in the transfer of heat, e.g. to collect heat from the sand in a first stage of the process, and to release it again in a second stage of the process to air.

The transfer of heat aspect of the process of the invention may include passing either fresh (i.e. cool) air or hot air through the metal. Which of the two alternatives is utilised depends upon the temperature of the foundry sand which is to be treated. If foundry sand coming directly from the demoulding is used, i.e. sand with a relatively very high temperature, fresh air will be used to effect a cooling of the sand in addition to purification. On the other hand, if foundry sand is treated which, for example, has been stored and is cold, hot air will be used to raise the temperature of the sand so that it is immediately available for further working.

Whilst treatment of the sand with fresh air to cool it is only useful if the foundry sand contains layers of synthetic resin binding agents, excluding for example, hydrated used foundry sands such as green sand etc., the process according to the invention utilising hot air is also applicable to hydrated used foundry sands.

For the purification of, for example, green sand, the said is fed past contact surfaces and shredded metal edges or is brought into contact with separate vibrating particles of metal in a first stage of the process whilst, at the same time hot air is passed through the metal fibres. In a second stage of the process, the sand is once more fed past contact surfaces and edges of shredded metal or is brought into contact with separate vibrating particles of metal, whilst fresh air is passed through the metal fibres. This working method offers the possibility of reducing the water content of the used foundry sand by heating it in the first stage of the process, and of thus drying the used sand, after which it will usually have too high a temperature for immediate further working. For this reason, in the second stage of the process, the sand under renewed purification is subjected to cooling as a result of which the purified sand can be used directly for further working.

Layers of synthetic resin binding agents released during the purification according to the process of the invention, and also particles of dust released, are removed by the hot or fresh air so that the end product of the process is a clean sand suitable for further processing.

The invention includes apparatus for carrying out the process where metal wool or metal fibres are used, which comprises a perforated tube for mounting vertically and axially about a rotatable shaft having a plurality of disc members radially mounted thereon and received within the tube, the disc members being perforated and spaced axially of the shaft to form chambers within the tube for receiving the metal fibres or metal wool, means for vibrating the shaft, means for passing air laterally through the tube, and means for feeding foundry sand into the top of the tube.

By means of this apparatus, it is possible in a simple manner to carry out the process according to the invention in the following way. A grain of sand which is introduced into the vertical tube, the chambers in which have previously been filled with fine steel wool, travels as the pipe vibrates from top to bottom of the tube as it vibrates, passing in contact with the steel wool. The grain of sand brushes a large number of sharp edges of the wool and undergoes an additional purification by this brushing contact. Heat is exchanged if there is any difference in temperature between the grain of sand and the steel wool, so that the temperature of the sand in the superimposed levels of the vertical pipe may constantly change. Air passing through the steel wool either takes heat from the steel wool or releases heat to the steel wool, depending on the relative temperatures.

The use of the apparatus is especially advantageous if the foundry sand to be treated has been previously used with organic or inorganic binders. Water has little or no immediate effect on the sand.

For practical purposes, it is desirable if the foundry sand is supplied continuously to the apparatus. Preferably, the feeding means is operable to feed a stream of sand into the top of the tube around the shaft. Suitably, the feeding means is rotatable around the axis of the vertical tube. Using such a device, the shower of sand falling down into the tube forms a spiral, with the steel wool functioning alternately as receiver for heat from the sand and then as dispenser of heat to the cool air. If hot air is used in the process, the steel wool functions firstly as receiver for heat from the hot air and then as dispenser of heat to the sand.

In order that the invention may be more fully understood, one embodiment thereof will now be described, by way of illustration only, with reference to the accompanying drawing, in which:

FIG. 1 is a vertical sectional view, with a horizontal sectional view on A-A; and FIG. 2 is two apparati connected one behind the other for "two-stage" treatment.

Referring to the drawing, in a housing 1 is a vertical standpipe 2. This vertical pipe 2 has perforated walls with air admittable through the perforations 3 which comes from an inlet nozzle 4, enters through the perforations 3 into the interior of the vertical pipe 2 and from there via further perforations 3 leaves the apparatus by an exit nozzle 5.

Inside the vertical pipe 2 there is a vertical structure 6 at the top of which a vertically operating vibratory device 7 is attached. Along the support 6 there are several discs 8 arranged at intervals from each other and firmly connected with the structure 6 and which, together with this, are vibrated by means of the vibratory device 7. Fixed in the spaced between each two discs 8 are metal fibre packs 9, especially of metal wool. These packs 9 are secured by the discs 8, although the discs 8 are equipped with holes or perforations through which the foundry sand falls during vibration.

At the top of the apparatus there is a material feed-device in the form of a filler nozzle 10. This filler nozzle can be arranged in any desired way for rotation around the structure 6. In this way, it is possible to feed the foundry sand continuously to a different place at the top of the apparatus so that the foundry sand falling through the metal fibres of the packs 9 during the vibration of the structure 6, the disc 8 and the metal fibre packs 9, trickles through all the metal fibre packs in the form of a spiral-shaped shower.

At the lower end of the apparatus there is a discharge nozzle 11 through which the treated foundry sand is once again removable from the apparatus.

FIG. 2 shows two similar apparati connected one behind the other, in which the discharge nozzle 11*a* of the apparatus technically situated upstream into the feed nozzle 10*a* of the apparatus which is technically situated downstream according to the process. Whilst hot air is introduced into the inlet nozzle 4*a* of the upstream apparatus, cool air or fresh air is introduced into the inlet nozzle 4*b* of the apparatus situated downstream. Cooled hot air leaves through the exit nozzle 5*a* after passing through the steel wool packs 9*a*, taking with it dust picked up at the same time as the sand is purified. As against this, heated cool air leaves through the exit nozzle 5*b* after its passage through the steel wool packs 9*a*, removing once more dust gathered during the passage of the sand.

Both in the case of FIG. 1 and FIG. 2 the feed nozzles 10, 10*a* and 10*b* can be displaced in rotation around the longitudinal axis of the vertical pipe 2, 2*a*, 2*b*, for which in the represented case a motor 12 with a belt drive is used.

What we claim is:

1. Apparatus for purifying particulate material, comprising a tube defining a chamber, said tube having inlet and outlet means for supplying said particulate material into and out of said chamber; finely divided metallic material within said chamber, said finely divided metallic material defining a plurality of voids formed by a plurality of sharp edges; input means for uniformly feeding said particulate material into said tube and into said finely divided metallic material; output means for removing said particulate material from said tube, said particulate material brushing against said finely divided metallic material to thereby remove foreign matter carried by said particulate material, and said tube having air inlet and outlet means in communication with an air source for evacuating said removed foreign matter out of said tube; and vibratory means for vibrating said finely divided metallic material.

2. The structure recited in claim 1, and further including perforated discs dividing said chamber into compartments.

3. The structure recited in claim 2, and further including a central shaft connecting said discs, said input means feeding a stream of said particulate material around said shaft, said tube and said shaft being substantially vertically disposed, and said input means being at the top and said output means being at the bottom of said tube.

4. The structure recited in claim 1, wherein said tube is perforated, and said air inlet and outlet means communicate with the perforations for passing air laterally through said tube.

* * * * *